United States Patent [19]

Moore et al.

[11] Patent Number: 4,559,123

[45] Date of Patent: Dec. 17, 1985

[54] DEVICE FOR ELECTROLYTICALLY DEPOSITING A LINING METAL LAYER OVER A METAL STRIP

[75] Inventors: Jean-Pierre Moore, Watermael-Boitsfort; René Winand, Rixensart; Alain Weymeersch, Montegnée; Lucien Renard, Seraing, all of Belgium

[73] Assignee: "Cockerill-Sambre", Seraing, Belgium

[21] Appl. No.: 669,829

[22] Filed: Nov. 9, 1984

[30] Foreign Application Priority Data

Nov. 11, 1983 [LU] Luxembourg ..... 85086

[51] Int. Cl.[4] ..... C25D 17/00

[52] U.S. Cl. ..... 204/206; 204/211

[58] Field of Search ..... 204/206, 211

[56] References Cited

U.S. PATENT DOCUMENTS 3,650,935 3/1972 Andersson ..... 204/206

4,183,799 1/1980 Sellitto ..... 204/206

4,304,653 12/1981 Winand ..... 204/206

*Primary Examiner*—T. M. Tufariello

*Attorney, Agent, or Firm*—Browdy and Neimark

[57] ABSTRACT

There is described a device for electrolytically depositing, in a continuous operation and under a high current density, a lining metal layer over at least the one surface of a metal strip moving through an electrolytic bath, comprising at least one conducting roller cooperating with a cathode current supply, extending cross-wise relative to the strip movement direction and rotating about the axis thereof, in contact with the strip, substantially at the same circumferential speed as the traversing speed thereof, at least one anode being provided in the electrolytic bath facing at least the one surface of the strip moving through said bath, device in which said conducting roller is at least partly hollow, and the cathode current supply comprises a series of parallel-connected contacts which are distributed over that inner cylinder-like surface of the roller which lies opposite that outer surface portion the strip is applied on.

14 Claims, 4 Drawing Figures

DEVICE FOR ELECTROLYTICALLY DEPOSITING A LINING METAL LAYER OVER A METAL STRIP

This invention relates to a device for electrolytically depositing, in a continuous operation and under a high current density, a lining metal layer over at least the one surface of a metal strip moving through an electrolytic bath, comprising at least one conducting roller cooperating with a cathode current supply, extending cross-wise relative to the strip movement direction and rotating about the axis thereof, in contact with the strip, substantially at the same circumferential speed as the traversing speed thereof, at least one anode being provided in the electrolytic bath facing at least the one surface of the strip moving through said bath.

In the devices as known up to now of this type, notably those devices in which very fine deposits are obtained on a metal sheet or strip moving with a relatively high speed facing an anode, the current density is rather low due to an overheating danger.

Indeed in said known devices, the cathode current is fed to the conducting roller through the revolution shaft thereof, and it has been noticed that the current density in the sheet may but with difficulty rise above 150 A/dm$^2$ without causing at the revolution shaft level, such high current densities as to cause an overheating and consequently a distortion of said revolution shaft and even of the roller.

This may bring the danger of damaging the roller and lowering the contact area between said roller and the sheet, with as result the formation of sparks at this level, which will unavoidably have an influence on the quality of the cathodic deposit over the sheet.

One of the essential objects of this invention lies in providing a new device for electrolytically depositing, in a continuous operation and under a current density which may reach up to 350 A/dm$^2$ per sheet side, without any danger of overheating or other possible problem which might have an influence on the working of the device or the deposit quality.

For this purpose, in the device according to the invention, the conducting roller is at least partly hollow, and the cathodic current supply comprises a series of parallel-connected contacts which are distributed over the inner cylinderlike surface of the roller which lies opposite that outer surface portion the strip is applied on.

Advantageously, said contacts comprise current-supply brushes which are resiliently and slidably applied against said inner surface of the roller opposite to that surface the strip cooperates with.

In a particularly advantageous embodiment of the invention, the roller inner cylinder-like surface is eccentric relative to the outer cylinder-like surface thereof, the curvature center of said latter surface lying on the roller revolution axis.

In a preferred embodiment of the invention, the roller comprises a conducting cylinder-like casing the outer surface of which cooperates with the strip, and the inner surface of which cooperates with the cathode-current supply contacts, said casing being mounted on at least one means integral with a revolution shaft rotating about the casing outer surface axis.

Other details and features of the invention will stand out from the following description, given by way of non limitative example and with reference to the accompanying drawings, in which.

In the various figures, the same reference numerals pertain to similar or identical elements.

The invention relates to a device for electrolytically depositing, in a continuous operation and under high current density, a lining metal layer over at least the one surface of a metal strip moving through an electrolytic bath.

The current density generally lies from 50 to 350 A/dm$^2$ per side.

This is more particularly a device for obtaining light coatings over metal strips moving with very high traversing speed, up to 600 meters per minute.

Figure 1:
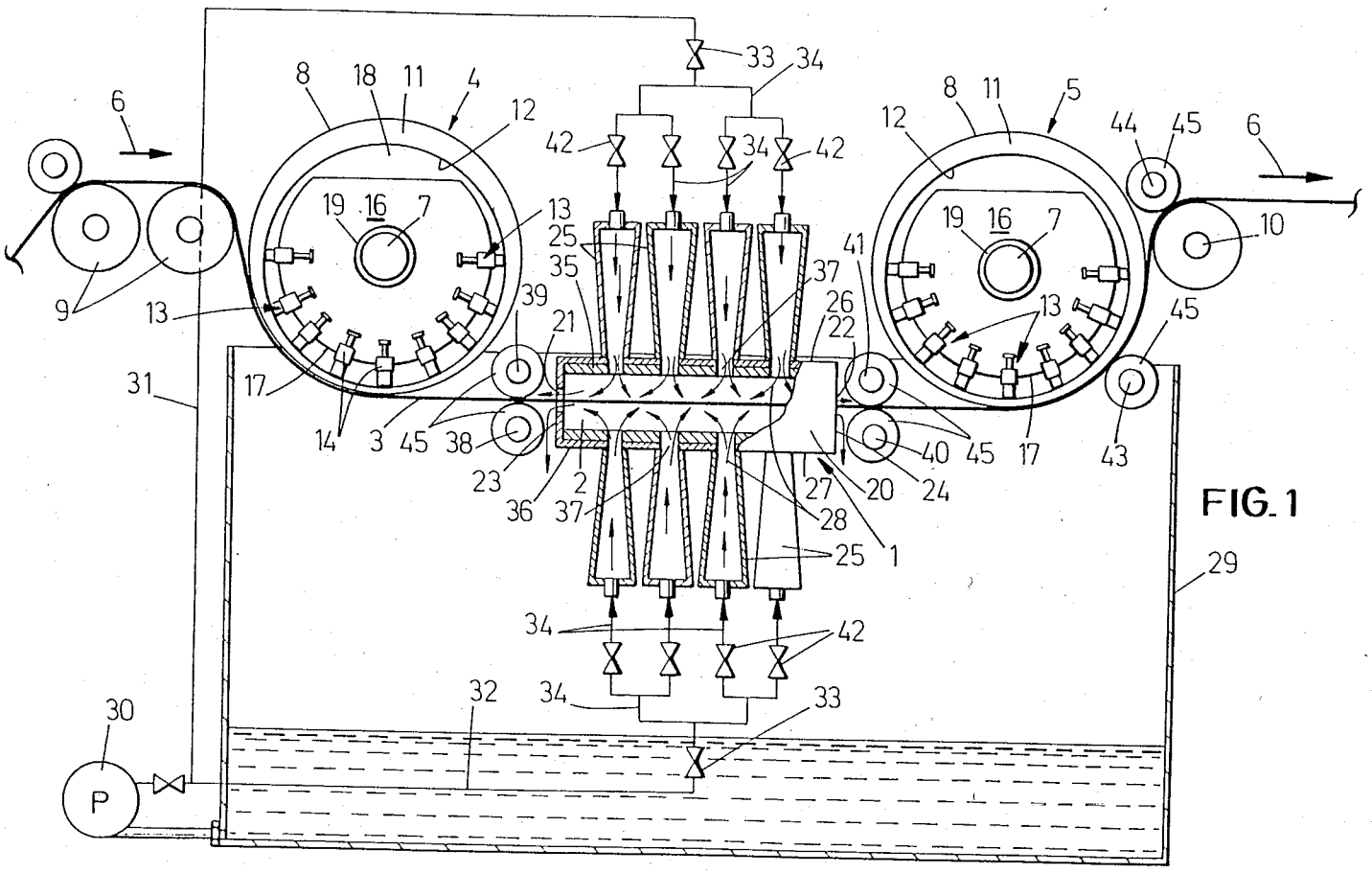
FIG. 1 is a diagrammatic lengthwise section view through a particular embodiment of a device according to the invention.

The embodiment of the device according to the invention as shown in FIG. 1, comprises an electrolysis cell 1 containing an electrolyte bath 2 through which moves a metal strip 3, notably a steel strip.

On either side of said cell is provided a conducting roller 4,5 extending cross-wise relative to the strip movement direction, as shown by arrow 6.

Said rollers each revolve about a shaft 7. The steel strip 3 is guided over a portion from the outer cylinder-like surface 8 of roller 4, through a cylinder 9 pressed against said cylinder-like surface. Consequently, the metal strip 3 has a traversing speed which is equal to the circumferential speed of roller 4.

In the same way, the metal strip coming out of the electrolysis cell 1 is deflected along the outer cylinder-like surface 8 of the conducting roller 5, by means of a cylinder 10.

According to the invention, each said conducting rollers is at least partly hollow, and is perferably comprised of a cylinder-shaped casing 11 the outer surface 8 of which cooperates with the strip 3, and the inner surface 12 of which cooperates with a series of cathode current supply contacts 13, which are connected in parallel and distributed over that portion of said inner cylinder-like surface 12 opposite to the portion of outer surface 8 the metal strip is pressed against.

In this way, the conducting rollers 4 and 5 allow feeding to the metal strip 3 a high cathode current density, without any danger of local heating as in the known devices.

Said contacts 13 are comprised of brushes which are applied resiliently and slidably against said inner surface 12 of the cylinder-shaped casing 11 of rollers 4 and 5.

More particularly, said brushes are slidably mounted inside sheaths 14, against the action of a helix spring 15 which insures the contact between the brushes and the inner surface 12.

Said sheaths 14 bearing the brushes 13, are then projectingly arranged and distributed along the circular edge 17 of a plate 16, located inside the cylinder-shaped casing 11.

Advantageously, the inner cylinder-like surface 12 of casing 11, is eccentric relative to the outer cylinder-shaped surface 8 and also relative to the lower circular edge of plate 16 supporting the sheaths 14.

Consequently, the thickness of casing 11 is not constant, but varies continuously between a maximum and a minimum.

Thus during the revolution of said cylinder-shaped casing 11, the brushes 13 continuously undergo a to-and-fro motion inside the sheaths 14 thereof, which avoids locking of springs 15 and thus insures a perfect contact between brushes 13 and said inner surface 12 of casing 11.

In said embodiment, the curvature center of the outer cylinder-like surface 8 and of the circular edge 17 of plate 16, thus lie on the revolution axis of rollers 4 and 5.

Figure 2:
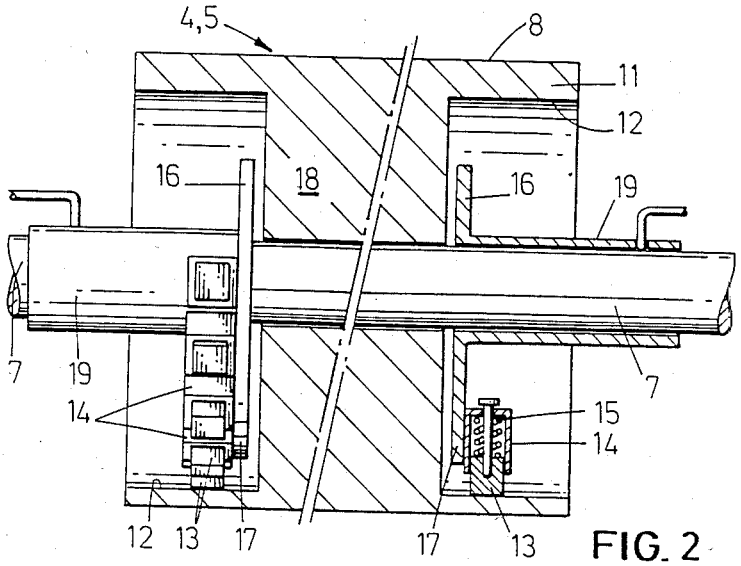
FIG. 2 is a section on a larger scale, along line II—II in FIG. 1.

In the embodiment as shown in FIG. 2, the contacts 13 are located adjacent to the side edges of casing 11, on either side of a center hub 18 integral with revolution axis 7.

Through the plates 16 bearing the brushes 13 is passed the revolution shaft 7, and they are integral with a sleeve 19 wherein said shaft rotates.

The plates 16 as well as the sleeves 19 might be made from a conducting material, to be thus directly usable for feeding the cathode current to the brushes 13. In such an embodiment, there could possibly be provided an insulating protecting layer on the outer surfaces of said plates 16 and sleeves 19.

The conducting rollers 4 and 5 lie outside the electrolytic bath 2, but as near as possible thereto to minimize the voltage loss in the strip as same passes through the bath.

The electrolysis cell 1 essentially comprises a closed box 20 provided with two slits 21 and 22.

The metal strip 3 enters the box 20 through slit 21, to then pass through the electrolyte 2 contained in said box and leave same through slit 22.

The electrolyte is continuously fed to box 20 by injectors 25 provided in the upper wall 26 and lower wall 27 thereof.

Thus the electrolyte injection occurs under pressure in box 20, cross-wise to the sheet movement direction therethrough, as shown by arrows 28.

The electrolyte leaves box 20 through said slits 21 and 22, and it is recovered in a tank 29 lying underneath box 20. By means of a cycling pump 30, the electrolyte from tank 29 is returned under pressure to the injectors 25.

In this regard, the electrolyte circuit comprises two main lines 31 and 32 which each end on a box side, and on each line is provided a main valve 33 allowing to adjust the electrolyte flow rate to the upper or lower side of box 20.

From said main lines, a series of parallel secundary lines 34 lead to each one of said injectors 25.

Inside box 20, against the upper and lower walls 26 and 27, are provided insoluble anodes 35 and 36 made for example from a lead-silver alloy.

Said anodes have facing the injectors 25, passageways 37 for the electrolyte.

The metal strip 3 passes into the electrolytic bath 2 in the middle plane between anodes 35 and 36, that is with an equal spacing from each said anodes. Said spacing is constant over the whole length of the anodes and generally lies between 8 and 20 mm.

To prevent the rollers 4 and 5 being moistened by the electrolyte overflowing from box 20, the metal strip passes between a pair of sealing cylinders 38 and 39 located between roller 4 and slit 21, and a pair of similar sealing rollers 40 and 41 located between slit 22 and roller 5.

Figure 3:
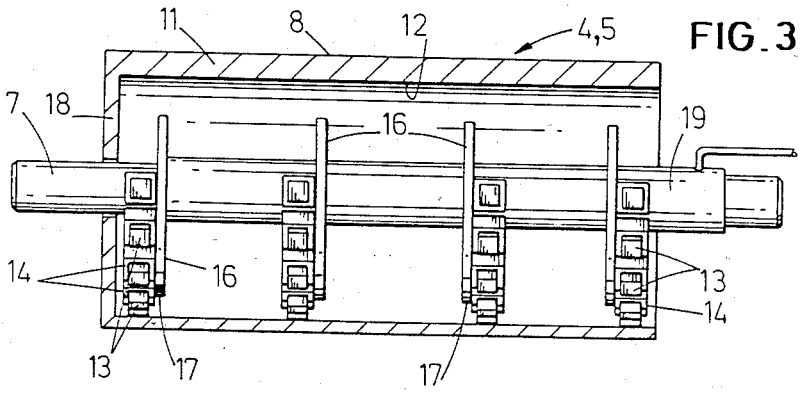
FIG. 3 is a diagrammatic lengthwise section, similar to FIG. 2, of a second embodiment of the device according to the invention.

FIG. 3 shows a third embodiment of a conducting roller 4 or 5 according to the invention.

Said roller differs from the roller as shown in FIG. 2, due to the brushes not being located adjacent the side edges of the cylinder-shaped casing 11, but being uniformly distributed over the inner surface 12.

In this embodiment, a hub 18 is provided on the one side edge of the cylinder-shaped casing 11. For rollers having some length, it might be possibly be useful to provide on that side opposite the hub, a removable cheek, not shown, allowing to support the opposite edge of the cylinder-shaped casing 11.

Due to the electrolyte being fed to the box 20 by injectors 25 along a direction substantially at right angle to the metal strip 3, there is generated in the electrolytic bath, a hydrodynamic turbulent flow. By means of the valves 33, 34 and 43 provided at the inlet to the injectors 25, it is possible to obtain a very regular hydrodynamic flow, thus allowing to insure the formation of a very homogeneous electrolytic deposit over the metal strip.

Figure 4:
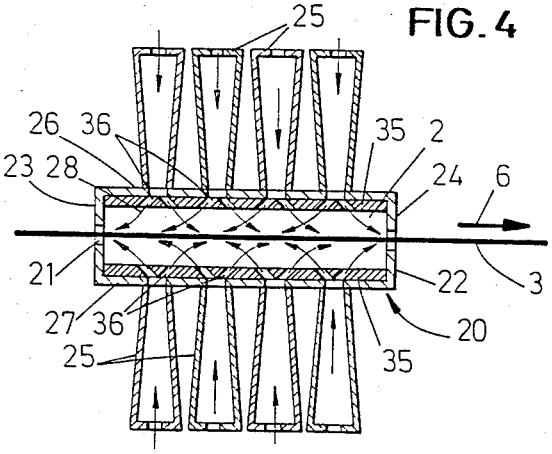
FIG. 4 is a diagrammatic lengthwise section of another portion from a third embodiment of the device according to the invention.

FIG. 4 shows a detail from another embodiment for the passageways 37 through the anodes 35 and 36.

In this embodiment, the electrolyte injected in box 20 undergoes a more-controlled slanting deflection along the surfaces of the metal strip 3.

The device according to the invention is further illustrated by actual examples of use as given hereinafter.

EXAMPLE 1

The device and electrolytic bath being used had the following characteristics:

Length of box 20: 500 mm.
Width of box 20: 400 mm.
Spacing between anodes 35 and 36 on the one hand, and metal strip 3 on the other hand: 10 mm.
Nature of anodes 4 and 5: lead-silver 0.8%.
Traversing speed of metal strip 3: 200 m/min.
Current density: 300 A/dm$^2$ (per side).
Nature of the electrolyte:
$Zn^{++}$:85 g/l.
$H_2SO_4$:135 g/l.
Temperature of the electrolytic bath: 50° C.
Nature of the resulting zinc deposit: 1.5 g/m$^2$ deposit, homogeneous and shiny (per side).
Cathode current efficiency: 98%.
Total current: 9000 A.
Width of the metal strip, comprised of a steel sheet: 300 mm.
Electrolyte flow rate: 30 m$^3$/h.

EXAMPLE 2

The cell being used was the same as for example 1.
The other parameters were as follows:
Traversing speed of metal strip 3: 400 m/min.
Current density: 250 A/dm$^2$ (per side).
Nature of the electrolyte:
$CrO_3^{++}$:45 g/l.
$H_2SO_4$:0.5 g/l.
Temperature of the electrolytic bath: 60° C.
Deposit of Cr+CrOx: 114 mg/m$^2$ of Cr (for both sides).
Efficiency of the cathode current for the metal chromium deposit: 34%.
Total current: 7500 A.
Width of the steel strip: 300 mm.

Electrolyte flow rate through box 20: 25 $m^3/h$.

The maximum cathode current value is dependent on the size of the conducting rollers 4 and 5, but it will in any case be larger than 100,000 amperes for a roller with a length of 1500 mm and a diameter of 500 mm.

The number of brushes 13 is also dependent on the place available inside the rollers. Thus for rollers with some length, it would be possible to provide a plurality of brush rows, for example two rows on either side of hub 18 bearing casing 11.

For relatively short boxes 20, it might possibly be possible to use but one conducting roller, which will preferably be located upstream of box 20, that is roller 4 in FIG. 1.

To line or coat but one surface of metal strip 3, it is only required to power but that anode facing that side to be lined of the strip.

The supply of anode current may be example be made through a copper rod, not shown in the figures.

There is also the possibility of using soluble anodes, which will of course require means for retaining inside the electrolytic bath, a substantially constant spacing between the anodes and the strip, and for replacing the anodes as they are used up.

As it might in some cases be possible to use means known per se, it has not been considered useful to show same in the figures.

Finally at the outlet from the box, for example where the metal strip is deflected along roller 5, said strip may undergo a drying with additional cylinders 43 and 44 lying on either side of metal strip 3. Said additional cylinders as well as cylinders 38 to 41 may for example be provided with a layer from substantially resilient material 45 absorbing moisture.

It must be understood that the invention is in no way limited to the above-described embodiments and that many changes may be brought therein without departing from the scope of the invention as defined by the appended claims. For instance, the size and shape of the contacts, as well as the mounting thereof inside the rollers, may vary together with the number thereof.

On the other hand, to obtain relatively thick deposits, it may be enough to arrange a plurality of devices according to the invention, in series.

Means may possibly be provided to cool the brushes 13, when necessary.

In still another variation according to the invention, notably relative to the embodiment as shown in FIG. 3, the shaft 7 may be fixed and in such a case, the plates 16 are then secured to said shaft, while the roller 4, 5 cooperates with said shaft through a rolling bearing.

We claim:

1. Device for electrolytically depositing, in a continuous operation and under a high current density, a lining metal over at least the one surface of a metal strip moving through an electrolytic bath, comprising at least one conducting roller cooperating with a cathode current supply, extending crosswise relative to the strip movement direction and rotating about the axis thereof, in contact with the strip, substantially at the same circumferential speed as the traversing speed thereof, at least one anode being provided in the electrolytic bath facing at least the one surface of the strip moving through said bath, device in which said conducting roller is at least partly hollow, and the cathode current supply comprises a series of parallelconnected contacts which are mounted on at least one fixed support and are distributed over the inner cylinder-like surface of the roller which lies opposite that outer surface portion the strip is applied on and which is eccentric relative to the outer cylinderlike surface thereof, the curvature center thereof lying on the roller revolution axis .

2. Device as defined in claim 1, in which said contacts comprise current-supply brushes which are resiliently and slidably applied against said inner surface of the roller opposite to that surface the strip cooperates with.

3. Device as defined in claim 2, in which said brushes are slidably mounted inside sheaths, against the action of a spring allowing to press said brushes against said roller inner surface.

4. Device as defined in claim 1, in which the contacts are arranged adjacent both side edges of said roller.

5. Device as defined in claim 1, in which said roller comprises a cylinder-shaped conducting casing the outer surface of which cooperates with the strip, and the inner surface of which cooperates with the cathode current supply contacts, said casing being mounted a hub integral with a revolution shaft rotating about the axis of the casing outer surface.

6. Device as defined in claim 5, in which said support bearing the brushes is essentially comprised of a fixed plate arranged inside the cylinder-shaped casing, substantially in parallel relationship with the disk said casing is mounted on.

7. Device as defined in claim 6, in which the revolution shaft of the cylinder-shaped casing passes through the fixed plate bearing the brushes, and said plate is integral with a sleeve inside which said revolution shaft rotates.

8. Device as defined in claim 7, in which said plate and sleeve are made from a conducting material, so as to be usable as cathode current supply to the brushes.

9. Device as defined in claim 1, in which said conducting roller is arranged outside the electrolytic bath.

10. Device as defined in claim 1, in which the metal sheet passes between at least one pair of sealing rollers arranged between the roller and the electrolytic bath, so as to prevent moistening the roller with the electrolyte.

11. Device as defined in claim 1, which further comprises a box containing the electorlytic bath and having two slits in opposite side walls, through which said strip passes through the electrolytic bath, injection means being provided to feed the electrolyte under pressure to said box, cross-wise to the movement direction of said strip therethrough, said electrolyte leaving the box through said slits and being recovered in a tank arranged underneath the box, to be recycled to the injection means.

12. Device as defined in claim 11, in which said injection means comprise valves for adjusting the electrolyte flow rate inside said box.

13. Device as defined in claim 1, in which the strip moves through the electrolytic bath at a distance between 8 and 20 mm from the anode.

14. Metal strip, notably steel sheet, lined with a metal layer by means of the device as defined in claim 1.

* * * * *